US006666348B2

(12) United States Patent
Fore et al.

(10) Patent No.: US 6,666,348 B2
(45) Date of Patent: Dec. 23, 2003

(54) CONTAINER ASSEMBLY

(76) Inventors: Frank A. Fore, 40 E. Riverside Dr., Jupiter, FL (US) 33469; Robert S. Fore, 414 E. Maxwell St., Lakeland, FL (US) 33803

( * ) Notice: Subject to any disclaimer, the term of this patent is extended or adjusted under 35 U.S.C. 154(b) by 0 days.

(21) Appl. No.: 10/035,565

(22) Filed: Dec. 28, 2001

(65) Prior Publication Data

US 2003/0121917 A1 Jul. 3, 2003

(51) Int. Cl.[7] ..... B65D 45/00; B65D 6/38

(52) U.S. Cl. ..... 220/4.21; 220/669; 220/671; 220/676; 220/315; 220/324

(58) Field of Search ..... 220/4.21, 324, 220/326, 784, 786, 788, 671, 676, 608, 623, 913, 315, 323, 670, 674, 675, 669, 797, 798; 292/44, 50, 285

(56) References Cited

U.S. PATENT DOCUMENTS

| | | | | | |
|---|---|---|---|---|---|
| 1,509,549 | A | * | 9/1924 | Freeland | 220/623 |
| 2,935,108 | A | | 5/1960 | Hall | |
| 3,186,574 | A | * | 6/1965 | Davidson | 217/60 D |
| 3,330,434 | A | * | 7/1967 | Bromley | 220/4.21 |
| 3,396,867 | A | * | 8/1968 | Garriga | 206/511 |
| 3,403,713 | A | * | 10/1968 | Good et al. | 206/521 |
| 4,079,880 | A | | 3/1978 | Edwards | |
| 4,776,459 | A | * | 10/1988 | Beckerman et al. | 206/467 |
| 4,986,438 | A | | 1/1991 | Borst | |
| 5,031,768 | A | | 7/1991 | Fischer | |
| 5,048,707 | A | | 9/1991 | Hallberg | |
| 5,060,814 | A | * | 10/1991 | Oglesbee | 220/833 |
| 5,377,860 | A | * | 1/1995 | Littlejohn et al. | 220/790 |
| 5,456,379 | A | * | 10/1995 | Krupa et al. | 220/835 |
| D377,450 | S | * | 1/1997 | Krupa et al. | D9/425 |
| D378,192 | S | * | 2/1997 | Krupa et al. | D9/425 |
| 5,601,206 | A | * | 2/1997 | Haas et al. | 220/527 |
| 5,695,087 | A | | 12/1997 | Tutton et al. | |
| 5,860,549 | A | | 1/1999 | Allers et al. | |
| 6,305,546 | B1 | * | 10/2001 | Saunders et al. | 206/541 |

* cited by examiner

*Primary Examiner*—Lee Young
*Assistant Examiner*—Joseph C Merek
(74) *Attorney, Agent, or Firm*—McHale & Slavin, P.A.

(57) ABSTRACT

The container assembly is adapted for high speed packaging of perishable items. The container is formed with ribbed walls to add rigidity to the structure. The reinforcing ribs are perforated to allow air to circulate through the packaged goods. The ribs are shaped to maintain the perforations open during stacking and shipping. The mouth of the container has a peripheral flange. The flange has integral hinged closures for securing a separate top.

13 Claims, 8 Drawing Sheets

CONTAINER ASSEMBLY

FIELD OF THE INVENTION

This invention relates to containers for perishable items such as fruit and vegetables and, in particular, to a container designed to facilitate high speed packaging and maintain packaged items in a protected, vented structure during shipping and storage.

BACKGROUND OF THE INVENTION

One of the more important aspects in the food industry is packaging of perishable items for delivery to market. The packaging must be accomplished with speed and must protect the packaged goods for a significant period of time for delivery. Saving man hours in packaging and reducing spoilage of perishable goods both contribute directly to profitability in the industry.

With regard to packaging of perishable items, the conventional method is to fill individual containers either by hand or mechanically. After the containers are filled a closure or top must be applied to the containers in such a manner that the closure or top will not be dislodged in normal shipping conditions. This application and sealing of the top or closure is a labor intensive operation.

With regard to the package itself, plastic materials have generally replaced the use of natural fibers and materials. The old baskets and sacks had both strength and porosity sufficient to maintain the integrity of the package and provide ventilation to the items inside. However, these older materials have been replaced, in large part, by plastic bags and plastic boxes. To provide adequate ventilation to the interior of the these molded or extruded plastic containers requires some form of perforation of the walls of the containers. The amount of perforation is restricted in these plastic containers because the perforations reduce the strength of the material. With a small number of perforations, the possibility of ventilation becoming blocked increases. Without proper ventilation, the perishable goods inside the package quickly become damaged.

SUMMARY OF THE INVENTION

Disclosed is a container assembly adapted for high speed packaging of perishable items. The container is formed with perforate ribbed walls to add rigidity and allow air to circulate through the package. The ribs are shaped to maintain the perforations open during stacking and shipping. The mouth of the container has a peripheral flange. The flange has living or integral hinged closures for securing a separate top.

Thus, it is an object of this invention to provide a container which may be filled and securely closed with a minimum amount of labor.

It is also an object of this invention to provide a plastic container with perforations providing adequate ventilation for perishable goods.

It is a further object of the invention to provide a container shaped to prevent the perforations from being closed during shipment.

Another object of the invention is to provide a the container with a mouth structure which permits high speed registration of a separate closure therewith.

It is a further object of invention to provide the mouth structure with hinged fasteners which may be mechanically closed to secure the closure to the container.

Objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE INVENTION

Figure 1:
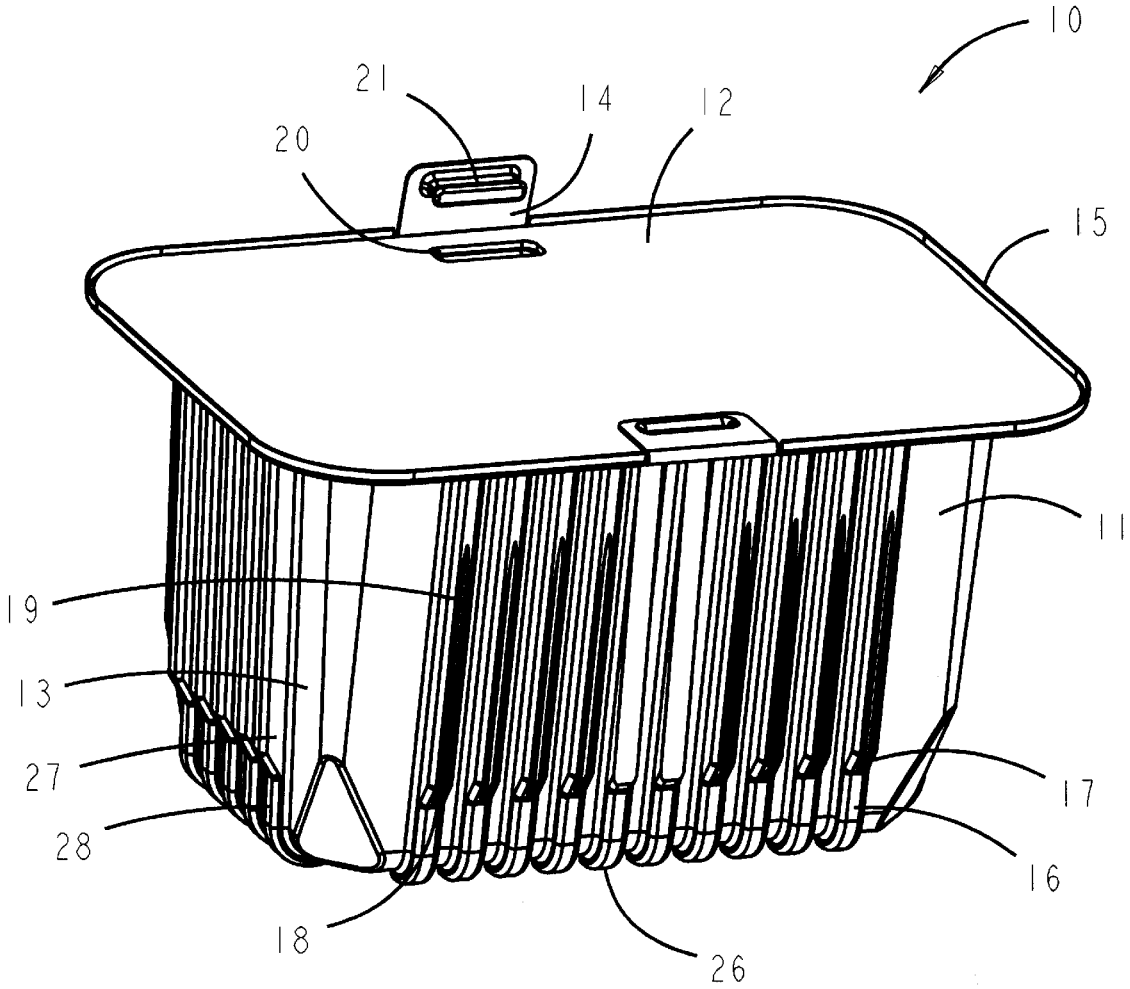
FIG. 1 is a perspective of one embodiment of the invention with a top in place.

FIG. 1 shows a plan view of the container 10 with side walls 11, end walls 13 and a separate top 12. The container 10 has a bottom 25 shown in FIG. 2. The container is made of any conventional plastic material such as polyethylene, polypropylene, polyvinyl or the like. The container is self supporting in that it will stand alone when empty. The side walls and end walls of the container have reinforcing ribs 16 extending from the top to the bottom of the walls. The ribs curve around the bottom of the side walls and end walls and form supporting surfaces 26 for the container. The bottom 25 of the container is recessed within the confines of the supporting surfaces 26.

Figure 2:
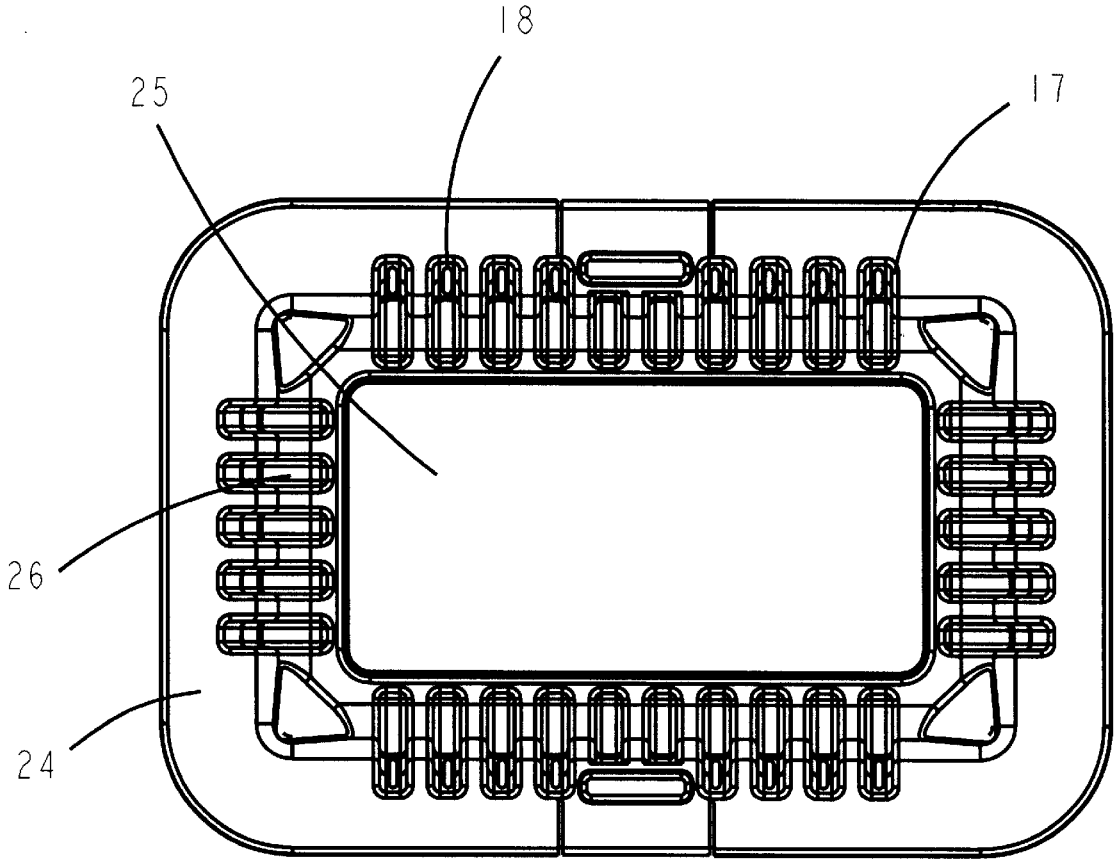
FIG. 2 is a plan view of the bottom of the container.
Figure 3:
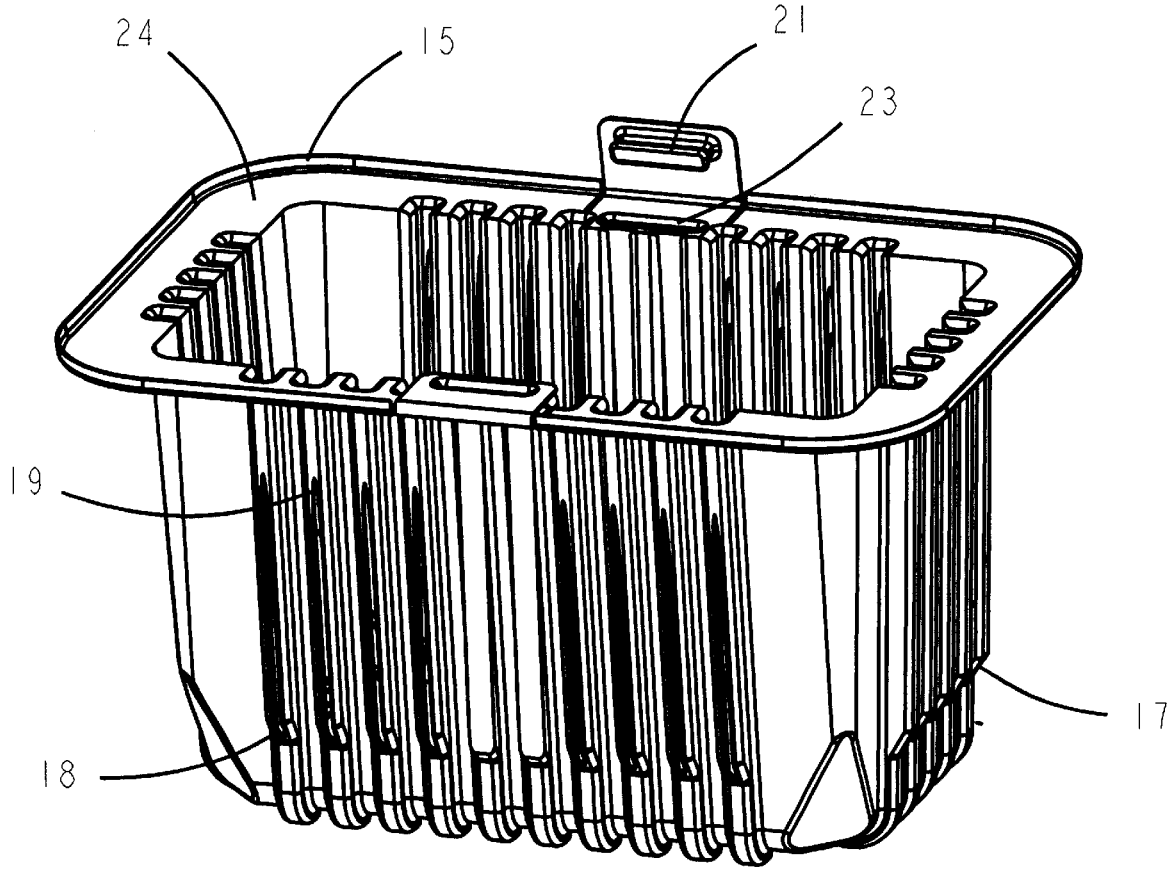
FIG. 3 is a plan view showing the interior of the container.

The ribs 16, shown in FIGS. 1–3, have a greater depth 27 toward to top of the container 11 and a lesser depth 28 toward the bottom. Each rib has a shoulder 17 tapering inwardly and downwardly. Each shoulder 17 contains an opening 18. The opening 18 extends upwardly as a slit in the rib. As shown in FIG. 1, the slit terminates at 19. The openings 18 provide ventilation to the interior of the container when it is sealed with top 12. The shoulder 17 provides protection for the opening 18 assuring ventilation even if the side walls and end walls are blocked. The mouth of the container 11 has a flange 24 extending outwardly about the periphery of the container. Flange 24 has a vertical extension 15 formed about the outer edge. The planar flange 24 also includes integrally formed hinged fasteners disposed above the side walls 11. The hinged fasteners 14 are movable from the open to closed position due to the flexibility and resilience of the plastic material from which the container is constructed. Also formed in the planar flange 24 are recesses 23 disposed to receive the pin 21 carried by the fastener 14. The fastener 14 is secured through friction forces, such as complimentary wedges shapes, between the pins 21 and the recesses 23.

Figure 4:
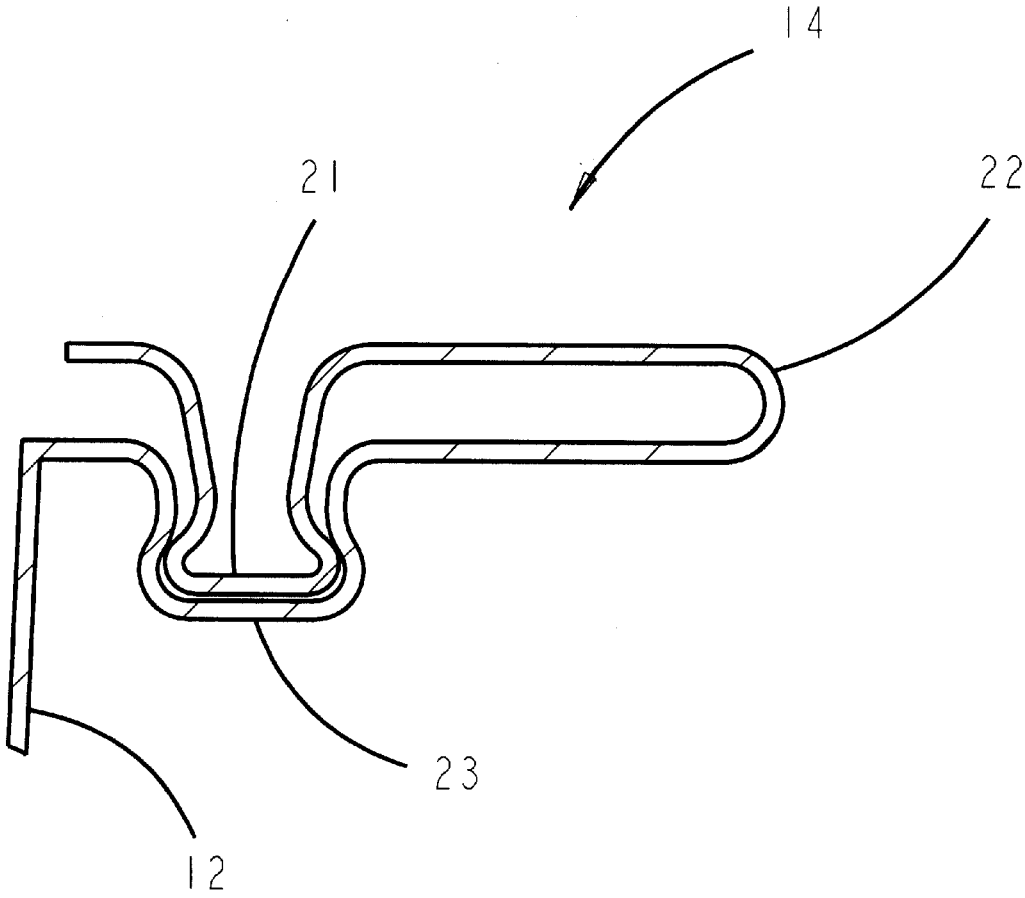
FIG. 4 is a cross section of the hinge structure.
Figure 5:
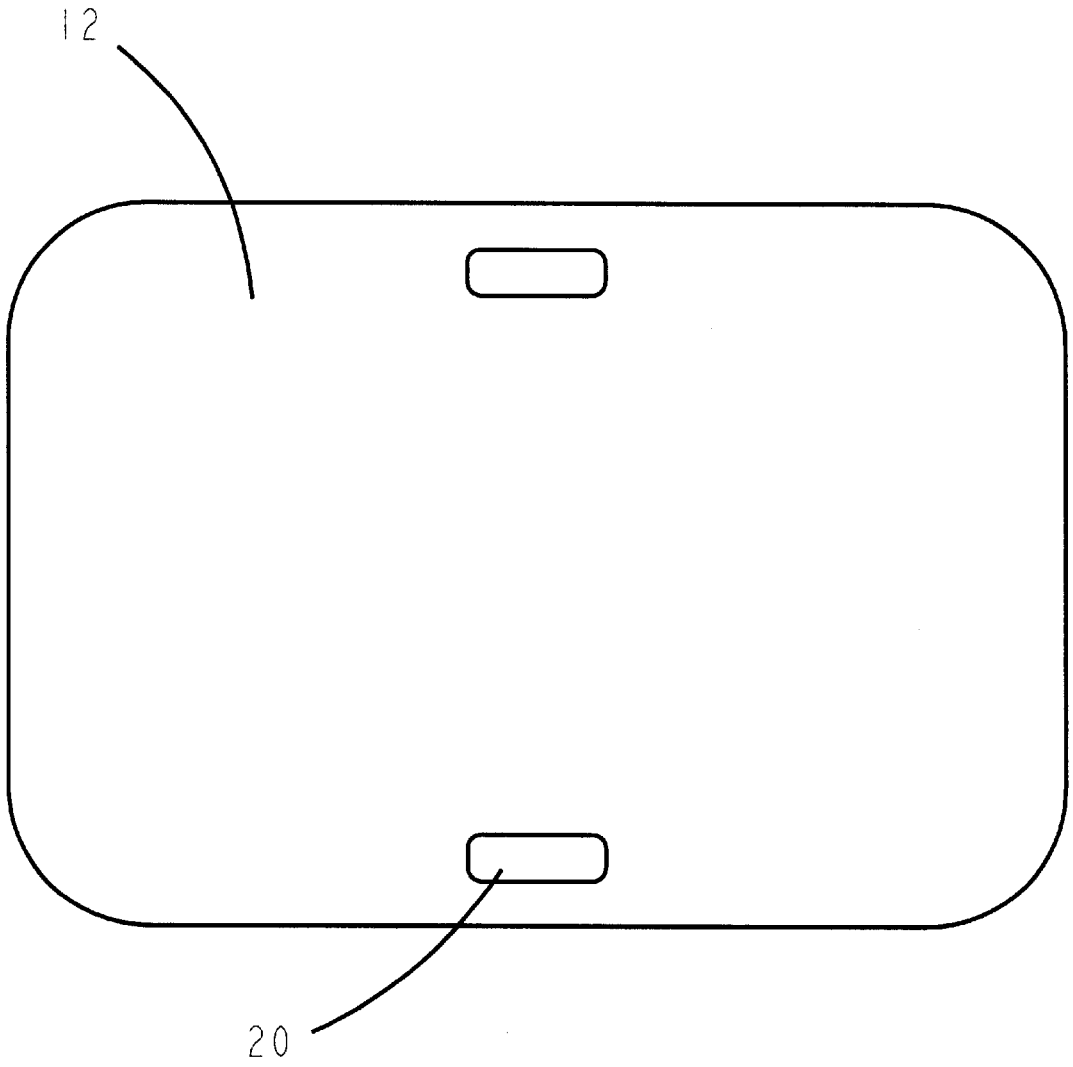
FIG. 5 is a plan view of one embodiment of a top.

As shown in FIG. 4, the pin 21 and the recess 23 are shaped to provide a snap fit. The separate top 12 shown in FIG. 5 has an apertures 20. The top may be made of paper, cardboard, plastic or foil. The apertures 20 are placed in the top 12 to accommodate the pins 21. The periphery of the top 12 closely approximates the shape formed by the upstanding edge 15 of the flange 24.

Figure 6:
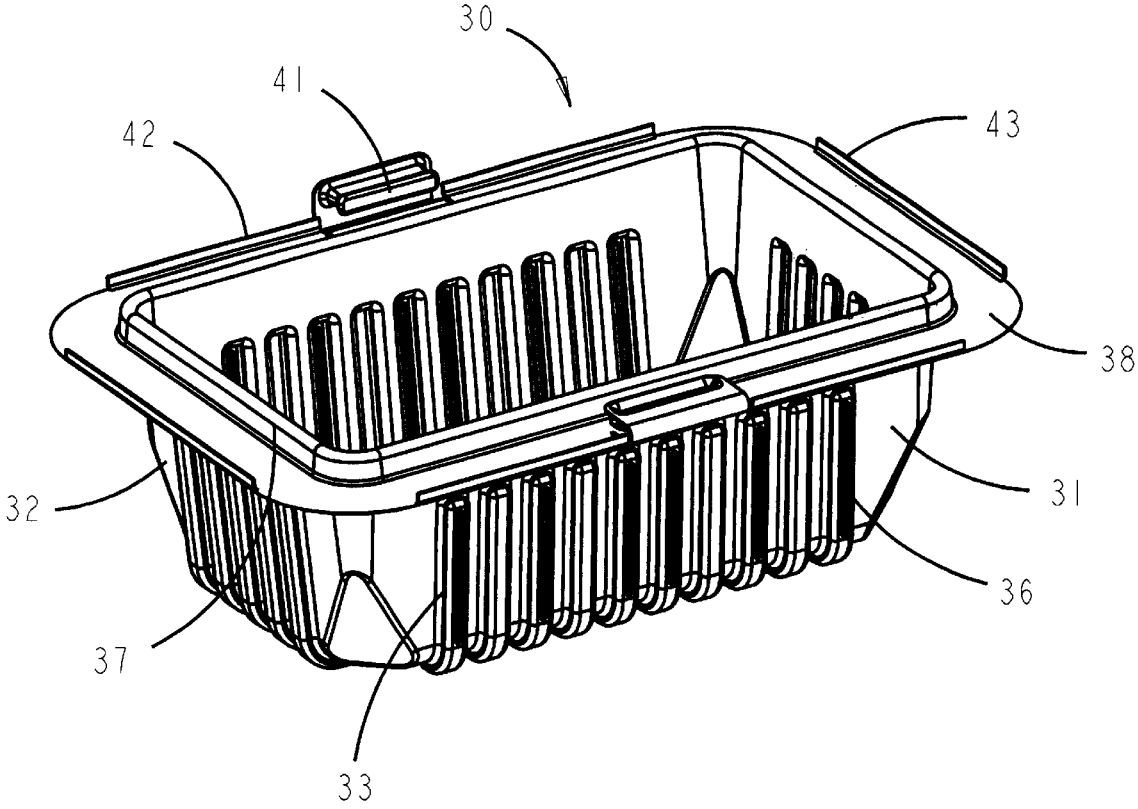
FIG. 6 is a perspective showing the interior of another embodiment of the container with another top.

The container 30, shown in FIG. 6, has the general shape of the container of FIG. 1. The sides 31 and end walls 32 are formed with reinforcing ribs 33 extending from near the top of the container to the bottom. The ribs 33 continue around the bottom of the wall and form supporting surfaces 34 for the container. The bottom 35 is recessed within the supporting surfaces. The ribs 33 are formed with a generally constant depth throughout the length. Some of the ribs have ventilating apertures 36 in the form of elongated slits. The upper end of the ribs terminate in the side and end walls below the mouth of the container.

Figure 8:
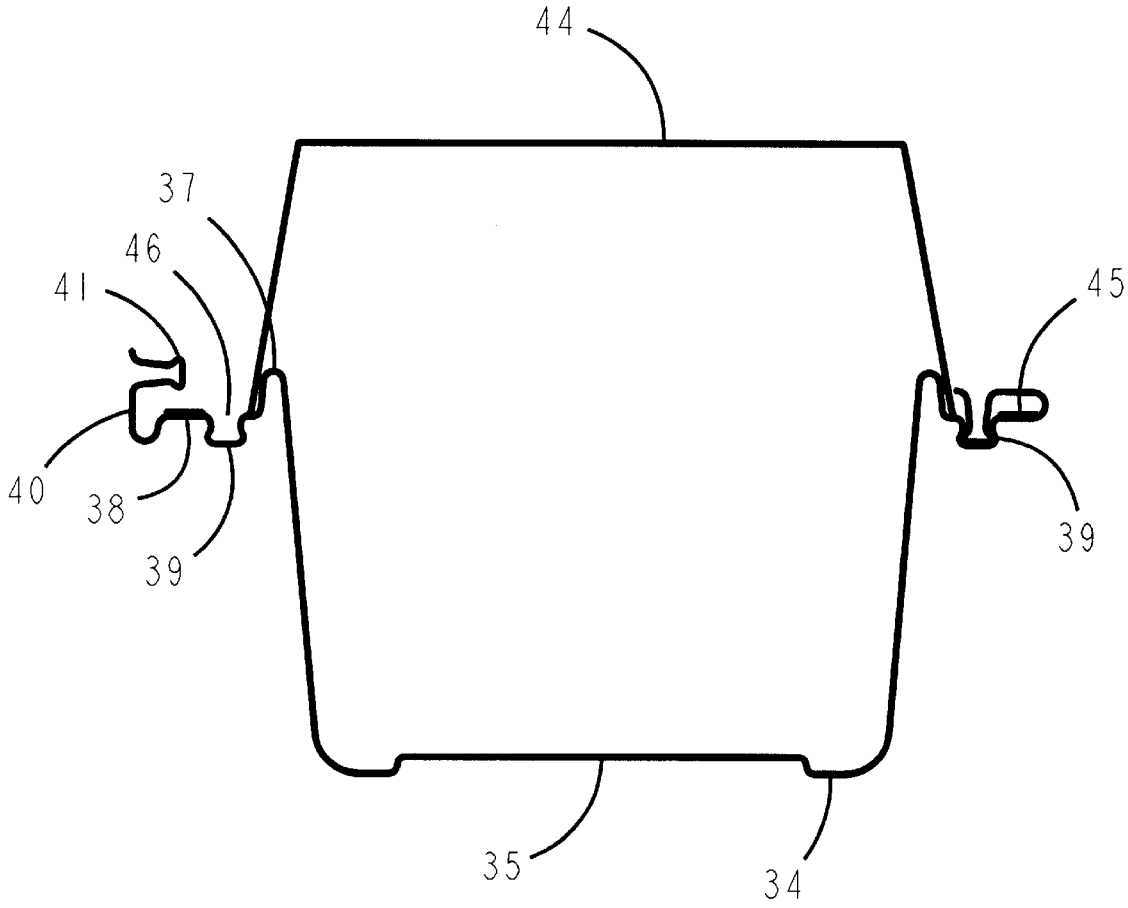
FIG. 8 is a cross section on line 8—8 of FIG. 7.

The mouth of the container 30 is formed with a raised circumferential shoulder 37 and a lower integral planar peripheral flange 38 extending outwardly beyond the sides and end walls generally parallel to the bottom 35. The flange overhangs the upper ends of the reinforcing ribs 33. The overhanging flange 38 prevents the apertures in the ribs from being blocked. The peripheral flange 38 has opposed recesses formed adjacent outward extensions 40 which carry pins 41. Because of the flexibility and resilience of the plastic material from which the container is made, the extensions 40 may be folded inwardly in the nature of a hinge. The pins 41 are received in the recesses in a snap fit, as shown in FIGS. 4 and 8. The flange 38 has vertical extensions 42 located above the side walls and vertical extensions 43 located above the end walls.

Figure 7:
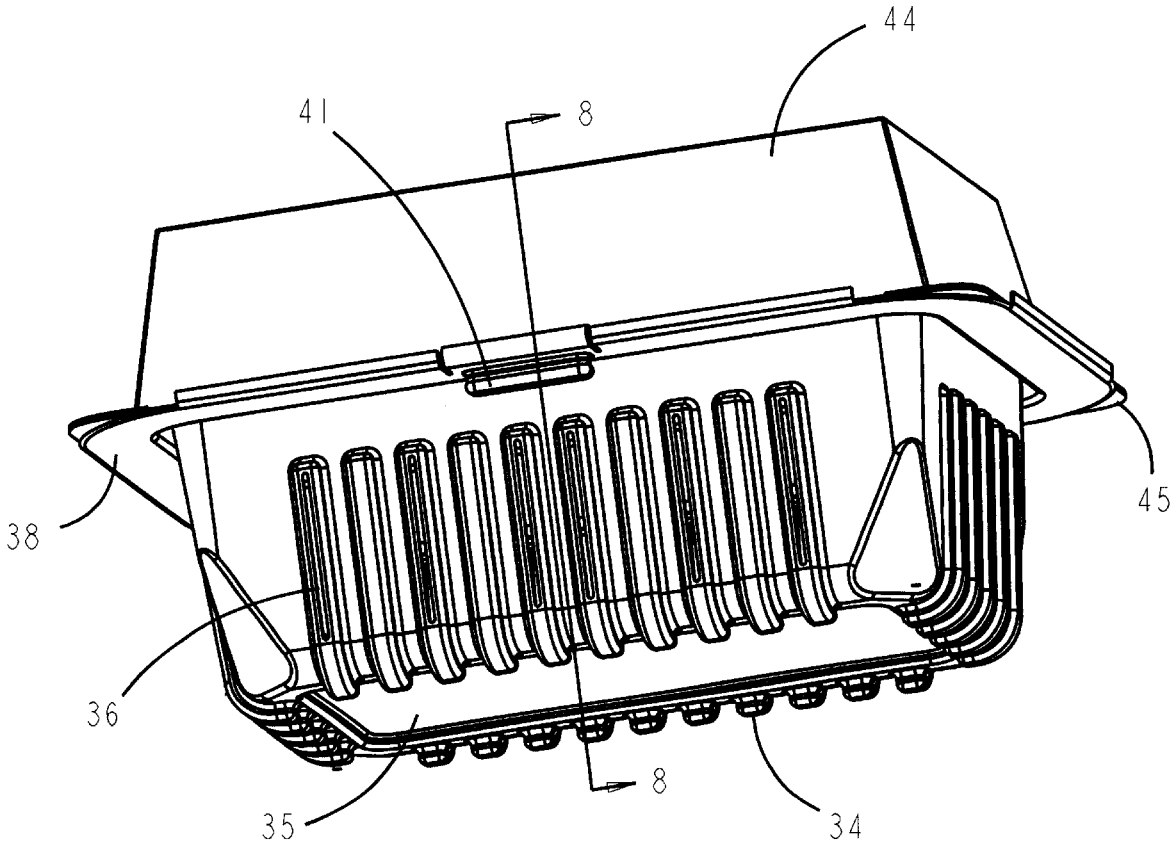
FIG. 7 is a perspective of the embodiment of FIG. 6 with another top in place.

The top 44, shown in FIGS. 7 and 8, is formed as a concave-convex enclosure having an opening approximating the exterior dimensions of the shoulder 37 and having a peripheral planar flange 45. The flange 45 has opposed apertures 46. When the top is registered with the container, the flange 38 and flange 45 are superposed and the peripheral edges of the flange 45 contact the vertical extensions 42 and 43. When the top 44 is fastened to the container 30, the pins 41 extend through the apertures 46 into recesses 39.

In the high speed packaging operation, the containers of this invention may be filled and the tops may be fastened without manual labor. Because of the flexibility and resilience of the fasteners, they may be hinged and secured mechanically.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A container having a closed bottom, an open mouth, and contiguous walls extending between said closed bottom and said open mouth, said walls having ribs extending between said closed bottom and said open mouth, said ribs formed with an elongated slot throughout a major portion of their length, said open mouth has a planar flange about the periphery, said flange extending outwardly beyond said ribs, said flange terminating with a vertical extension, said planar flange contains at least two opposed integral fasteners located approximately 180 degrees from each other about the periphery of said flange, said fasteners composed of a recess and an adjacent planar hinge portion of said flange, said hinge portion carrying a pin which forms a friction fit in said recess wherein a top is secured to said container, said top having a planar surface in contact with said planar flange of said container, said planar surface having at least two apertures located 180 degrees from each other about said planar surface, said apertures aligned with each of said recesses of said fasteners.

2. A container of claim 1 wherein said closed bottom is recessed and said ribs form supporting surfaces.

3. A container of claim 1 wherein said vertical extension is continuous about said periphery of said flange.

4. A container of claim 1 wherein said vertical extension is discontinuous about said periphery of said flange.

5. A container of claim 4 wherein a continuous raised shoulder is formed between said mouth and said planar flange.

6. A container of claim 1 wherein said friction fit is formed as a snap fit.

7. A container of claim 1 wherein said top is planar.

8. A container of claim 1 wherein said top is concave-convex and has a planar flange.

9. A container having a closed bottom, an open mouth, and contiguous walls extending between said closed bottom and said open mouth, said walls having ribs extending between said closed bottom and said open mouth, said ribs formed with an elongated slot throughout a major portion of their length wherein said ribs have a greater depth near said open mouth and a lessor depth near said closed bottom, said ribs having a sloped shoulder connecting said lesser depth and said greater depth, one end of said elongated slot located in said sloped shoulder.

10. A container of claim 1 wherein said ribs have a greater depth near said open mouth and a lesser depth near said closed bottom, said ribs having a sloped shoulder connecting said lesser depth and said greater depth, one end of said elongated slot located in said sloped shoulder.

11. A container of claim 9 wherein said ribs terminate short of said open mouth.

12. A container of claim 5 wherein said ribs terminate short of said open mouth.

13. A container of claim 1 wherein said ribs terminate short of said open mouth.

* * * * *